US006809295B1

(12) United States Patent
Vargas

(10) Patent No.: US 6,809,295 B1
(45) Date of Patent: Oct. 26, 2004

(54) TELEVISION AND OVEN COMBINATION DEVICE

(76) Inventor: Debra C. Vargas, 5 Midwood Ave., Farmingdale, NY (US) 11735

( * ) Notice: Subject to any disclaimer, the term of this patent is extended or adjusted under 35 U.S.C. 154(b) by 0 days.

(21) Appl. No.: 10/682,254

(22) Filed: Oct. 10, 2003

(51) Int. Cl.[7] ..... H05B 6/64; G08B 3/00; A21B 3/00; A21B 1/00

(52) U.S. Cl. ..... 219/393; 219/209; 219/214; 219/391; 219/679; 219/720; 348/61; 348/739; 348/843

(58) Field of Search ..... 219/209, 214, 219/391, 393, 679, 720; 348/61, 739, 843

(56) References Cited

U.S. PATENT DOCUMENTS 4,131,786 A 12/1978 Cooper
4,225,776 A 9/1980 Meisner et al.
D273,836 S 5/1984 Ohyama et al.
4,580,754 A 4/1986 Hughes
4,628,351 A 12/1986 Heo
5,333,827 A 8/1994 Gioscia
5,382,939 A 1/1995 Hong
6,359,270 B1 * 3/2002 Bridson ..... 219/679
2004/0051645 A1 * 3/2004 Mahloch ..... 340/691.6

* cited by examiner

*Primary Examiner*—Joseph Pelham

(57) ABSTRACT

A television and oven combination device includes an oven having a back wall, front wall, a pair of side walls and a top wall. A flat-panel monitor has a viewing side, a rear side, a bottom edge, a top edge and a pair of side edges. At least one monitor support is attached to the back wall of the oven. The at least one monitor support includes an elongated member having an upper end and a lower end. The elongated member is vertically orientated. A coupler is attached to the upper end for coupling the elongate member to the flat-panel monitor.

15 Claims, 3 Drawing Sheets

TELEVISION AND OVEN COMBINATION DEVICE

BACKGROUND OF THE INVENTION

1. Field of the Invention

The present invention relates to television mounted devices and more particularly pertains to a new television mounted device which combines an oven and a flat-panel monitor mounted thereto.

2. Description of the Prior Art

The use of television mounted devices is known in the prior art and include such items as monitors mounted on refrigerators and on microwave ovens. However, while these devices fulfill their respective, particular objectives and requirements, the need remains for a combination device that includes a flat-panel monitor which is mounted on an oven so that a person using the oven may easily watch television while cooking instead of having to turn their heads to view another area and thereby risk injury.

SUMMARY OF THE INVENTION

The present invention meets the needs presented above by including an oven having a back wall, front wall, a pair of side walls and a top wall. A flat-panel monitor has a viewing side, a rear side, a bottom edge, a top edge and a pair of side edges. At least one monitor support is attached to the back wall of the oven. The at least one monitor support includes an elongated member having an upper end and a lower end. The elongated member is vertically orientated. A coupler is attached to the upper end for coupling the elongate member to the flat-panel monitor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
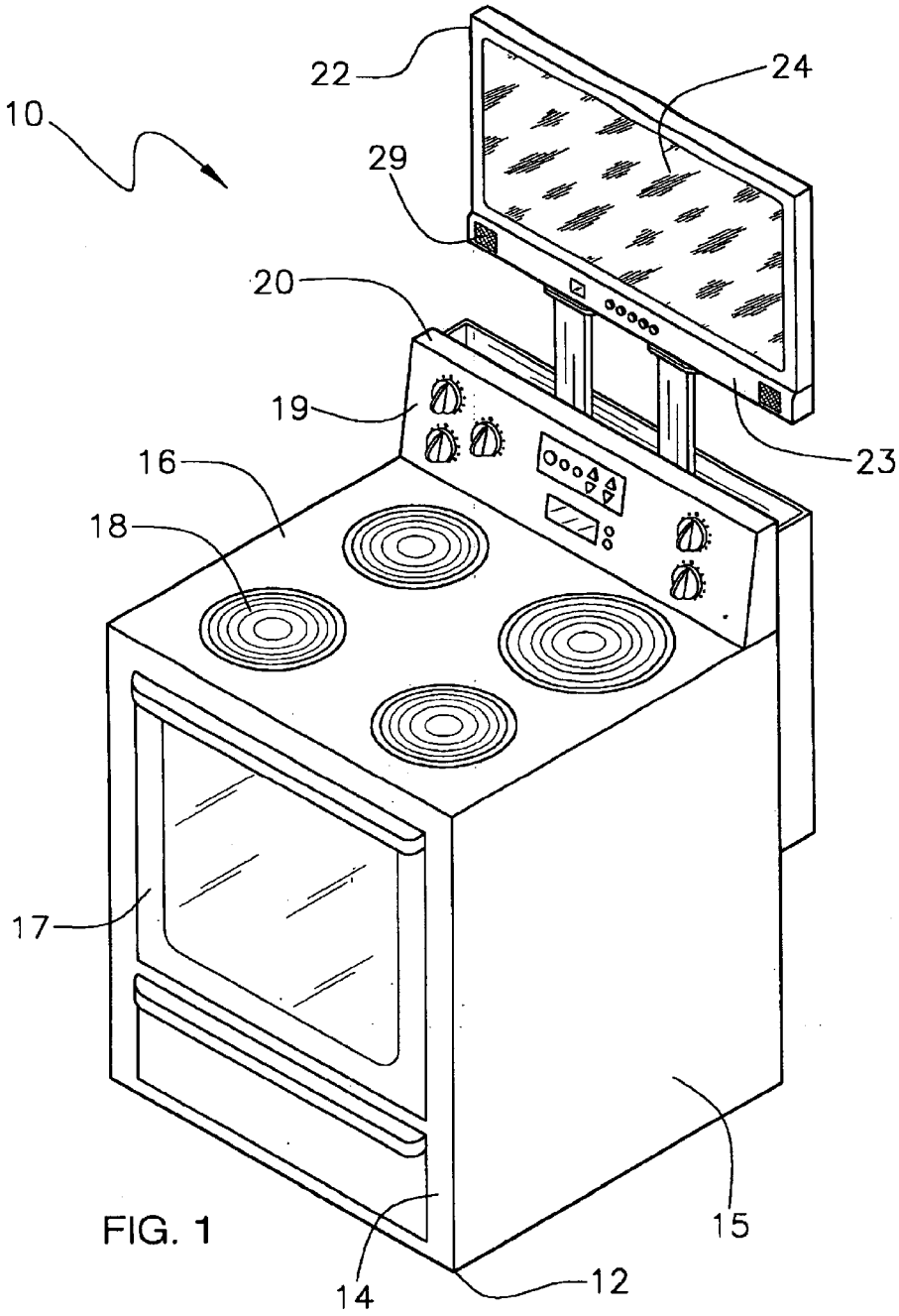
FIG. 1 is a schematic perspective front view of a television and oven combination device according to the present invention.
Figure 2:
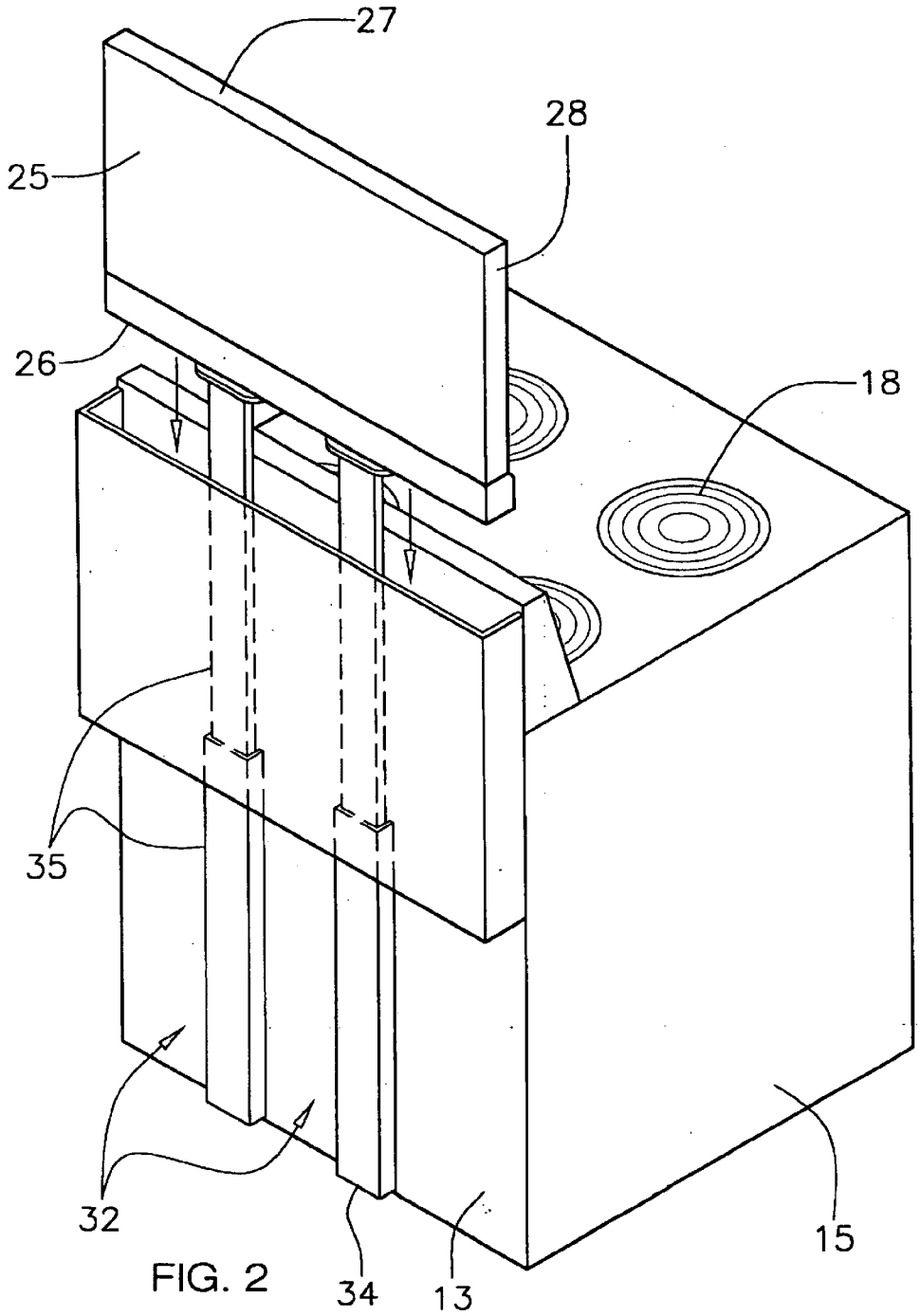
FIG. 2 is a schematic perspective rear view of the present invention.
Figure 3:
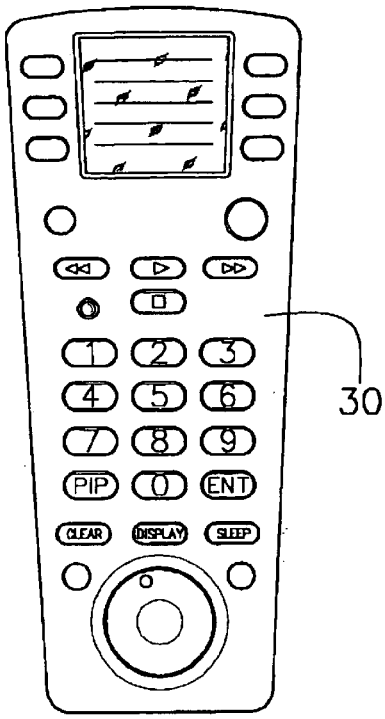
FIG. 3 is a schematic front view of a remote control of the present invention.
Figure 4:
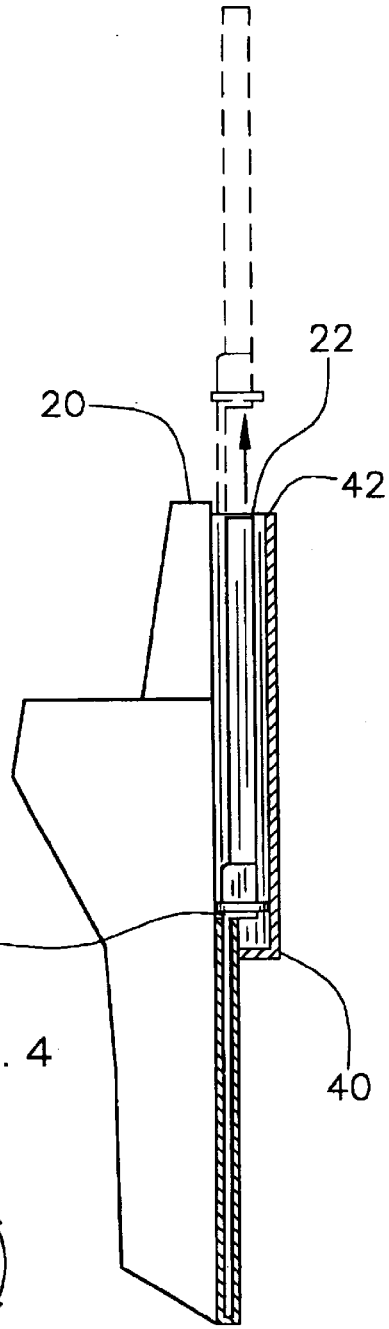
FIG. 4 is a schematic side view of the present invention.
Figure 5:
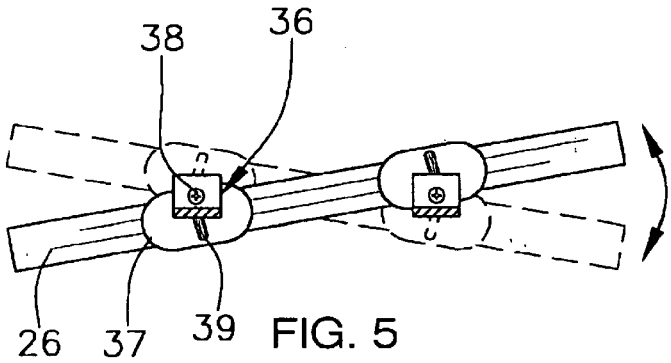
FIG. 5 is a schematic bottom view of the coupler of the present invention.

With reference now to the drawings, and in particular to FIGS. 1 through 5 thereof, a new television mounted device embodying the principles and concepts of the present invention and generally designated by the reference numeral 10 will be described.

As best illustrated in FIGS. 1 through 5, the television and oven combination device 10 generally includes a conventional type oven 12 having a back wall 13, front wall 14, a pair of side walls 15 and a top wall 16. The front wall 14 has a door 17 therein and the top wall 16 preferably includes a plurality of burners 18. Preferably there is a control panel 19 mounted on the top wall 16 at the back of the oven 12. The control panel 19 has an upper most portion defining the upper edge 20 of the oven 12.

The combination device also includes a conventional flat-panel monitor 22 that has a viewing side 23 which includes a view screen 24, a rear side 25, a bottom edge 26, a top edge 27 and a pair of side edges 28. The flat-panel monitor 22 is any conventional type of monitor or television that does not utilize cathode-ray tube technology but instead uses electroluminescent, gas discharge or liquid crystal displays or the like such that the monitor has a shallow physical depth. The monitor 22 may include its own tuner such that it is defined as a television. The monitor 22 also preferably includes speakers 29 and a remote control 30 for controlling the television functions of the monitor 22.

At least one, and preferably a pair of monitor supports 32 are attached to the back wall 13 of the oven 12. Each of the monitor supports 32 includes an elongated member having an upper end 33 and a lower end 34 and each is vertically orientated. The elongated members are selectively telescoping. The movement between sections 35 of the elongate members as they are selectively retracted or extended may be controlled by frictional engagement between the sections or other conventional methods or by a motorized process. Each of the elongated members includes a coupler 36. The couplers 36 are attached to the upper ends 33 for coupling the upper ends 33 to the bottom edge 26 of the flat-panel monitor 22 such that the view side 23 of the monitor 22 is generally directed toward the front wall 14 of the oven 12. The couplers 36 each include a plate 37 attached to the bottom edge 26 of the flat-panel monitor 22 and a rod 38 that attached to the respective upper end 33 and extends upwardly through a slot 39 in the plate 37 such that the plate 37 is pivotally coupled to the rod 38.

Preferably, in the case of telescoping supports 32, a storage housing 40 is attached to the back wall 13. The storage housing 40 has an open top 42. The open top 42 is positioned generally adjacent to the upper edge 20 of the oven 12. The storage housing 42 has a size adopted for removably receiving the flat-panel monitor 22 such that the flat-panel monitor 22 may be selectively extended below the upper edge 20 of the stove 12 and into the housing 40 or raised upwardly above the upper edge 20 of the stove 12.

Alternatively, the monitor support 32 and housing 40 may be sold as a separate device for selectively mounting a flat-panel monitor 22 to an oven 12. The monitor support 32 may be attached to the oven 12 and the monitor 22 using conventional fasteners or welding. Alternatively, if a pair of monitor supports 32 is used, they may be free standing and be stood upright against the oven 12. Generally, the supports 32 would be between the oven 12 and a wall so that there would be little fear of the supports 32 falling away from the oven 12.

In use, the oven 12 and the monitor 22 are each used as would be a conventional oven or monitor. However, the positioning of the monitor 22 on an oven 12 allows the viewer of the monitor 22 to do so while the user prepares a meal. The housing 40 and telescoping elongate members, or supports 32, allow the viewer to selectively position the monitor 22 in the housing 40 either when it is not being used or when something is being cooked which may damage the view screen 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A monitor and oven combination device, said device comprising:

an oven having a back wall, front wall, a pair of side walls and a top wall;

a flat-panel monitor having a viewing side, a rear side, a bottom edge, a top edge and a pair of side edges;

at least one monitor support being attached to said back wall of said oven, said at least one monitor support including;

an elongated member having an upper end and a lower end and being vertically orientated; and a coupler being attached to said upper end for coupling said elongate member to said flat-panel monitor.

2. The monitor and oven combination device of claim 1, wherein said elongated member is selectively telescoping such that said flat-panel monitor may be selectively raised above or lowered below an upper edge of said oven.

3. The monitor and oven combination device of claim 2, wherein flat-panel monitor is pivotally coupled to said elongated member by said coupler.

4. The monitor and oven combination device of claim 1, wherein flat-panel monitor is pivotally coupled to said elongated member by said coupler.

5. The monitor and oven combination device of claim 1, wherein said coupler includes a plate attached to said bottom edge of said flat-panel monitor and a rod being attached to said upper end of said elongated member and extending upwardly through a slot in said plate such that said plate is pivotally coupled to said rod.

6. The monitor and oven combination device of claim 2, further including a storage housing being attached to said back wall, said storage housing having an open top, said open top being positioned generally adjacent to an upper edge of said oven, said storage housing having a size adopted for removably receiving said flat-panel monitor such that said flat-panel monitor may be selectively extended into said housing.

7. The monitor and oven combination device of claim 3, further including a storage housing being attached to said back wall, said storage housing having an open top, said open top being positioned generally adjacent to an upper edge of said oven, said storage housing having a size adopted for removably receiving said flat-panel monitor such that said flat-panel monitor may be selectively extended into said housing.

8. The monitor and oven combination device of claim 1, wherein said at least one monitor support includes a pair of monitor supports each attached to said back wall of said oven.

9. The monitor and oven combination device of claim 2, wherein said at least one monitor support includes a pair of monitor supports each attached to said back wall of said oven.

10. The monitor and oven combination device of claim 3, wherein said at least one monitor support includes a pair of monitor supports each attached to said back wall of said oven.

11. A monitor and oven combination device, said device comprising:

an oven having a back wall, front wall, a pair of side walls and a top wall;

a flat-panel monitor having a viewing side, a rear side, a bottom edge, a top edge and a pair of side edges;

a pair of monitor supports being attached to said back wall of said oven, each of said monitor supports including;

an elongated member having an upper end and a lower end and being vertically orientated, said elongated member being selectively telescoping;

a coupler being attached to said upper end for coupling said upper end to said bottom edge of said flat-panel monitor, said coupler including a plate attached to said bottom edge of said flat-panel monitor and a rod being attached to said upper end and extending upwardly through a slot in said plate such that said plate is pivotally coupled to said rod;

a storage housing being attached to said back wall, said storage housing having an open top, said open top being positioned generally adjacent to an upper edge of said oven, said storage housing having a size adopted for removably receiving said flat-panel monitor such that said flat-panel monitor may be selectively extended into said housing.

12. A device for mounting a flat panel monitor on an oven, the oven having a back wall, front wall, a pair of side walls and a top wall, the flat-panel monitor having a viewing side, a rear side, a bottom edge, a top edge and a pair of side edges, the device including:

a pair of monitor supports being selectively attached to said back wall of said oven, each of said monitor supports including;

an elongated member having an upper end and a lower end and being vertically orientated; and a coupler being attached to said upper end for coupling said upper end to said bottom edge of said flat-panel monitor.

13. The device of claim 12, wherein said coupler includes a plate being selectively attached to said bottom edge of said flat-panel monitor and a rod being attached to said upper end and extending upwardly through a slot in said plate such that said plate is pivotally coupled to said rod.

14. The device of claim 12, wherein said elongated member is selectively telescoping.

15. The device of claim 14, further including a storage housing being attached to said back wall, said storage housing having an open top, said open top being positioned generally adjacent to an upper edge of said oven, said storage housing having a size adopted for removably receiving said flat-panel monitor such that said flat-panel monitor may be selectively extended into said housing.

* * * * *